US006152708A

United States Patent [19]

Ruessler et al.

[11] Patent Number: 6,152,708

[45] Date of Patent: Nov. 28, 2000

[54] FUEL INJECTION PUMP FOR AN INTERNAL COMBUSTION ENGINE

[75] Inventors: Karl-Friedrich Ruessler, Renningen; Berhard Bonse, Stuttgart; Wolfgang Braun, Ditzingen; Dieter Junger, Stuttgart; Joachim Kurz, Muehlacker; Roland Gronenberg, Leinfelden-Echterdingen; Hubert Greif, Markgroeningen, all of Germany

[73] Assignee: Robert Bosch GmbH, Stuttgart, Germany

[21] Appl. No.: 09/194,915

[22] PCT Filed: Jan. 24, 1998

[86] PCT No.: PCT/DE98/00217

§ 371 Date: Dec. 4, 1998

§ 102(e) Date: Dec. 4, 1998

[87] PCT Pub. No.: WO98/45592

PCT Pub. Date: Oct. 15, 1998

[30] Foreign Application Priority Data

Apr. 4, 1997 [DE] Germany ..... 197 13 868

[51] Int. Cl.[7] ..... F04B 7/04

[52] U.S. Cl. ..... 417/490; 123/506

[58] Field of Search ..... 417/490, 499, 417/500, 501; 123/506, 449, 467

[56] References Cited

U.S. PATENT DOCUMENTS

| | | | |
|---|---|---|---|
| 3,942,914 | 3/1976 | Hofer et al. | 417/289 |
| 4,537,170 | 8/1985 | Yamada et al. | 123/449 |
| 4,635,605 | 1/1987 | Faupel et al. | 123/449 |
| 4,718,385 | 1/1988 | Konrath | 123/449 |
| 4,741,314 | 5/1988 | Hofer | 123/449 |
| 4,788,959 | 12/1988 | Iiyama et al. | 123/503 |
| 4,831,986 | 5/1989 | Linder et al. | 123/449 |
| 4,924,833 | 5/1990 | Hofer et al. | 123/449 |
| 5,007,400 | 4/1991 | Babitzka | 123/506 |
| 5,161,509 | 11/1992 | Krieger et al. | 123/449 |

*Primary Examiner*—Charles G. Freay
*Assistant Examiner*—Robert Z. Evora
*Attorney, Agent, or Firm*—Ronald E. Greigg; Edwin E. Greigg

[57] ABSTRACT

A fuel injection pump for internal combustion engines, is proposed, with a distributor pump piston (6), which is supported in a housing bore (5) and on its jacket face, has a distributor groove (12), a filling groove (18), which is connected to a pressure relief chamber, and a pressure compensation surface (36). This filling groove constitutes a first leakage route (39) in the direction of the distributor groove (12) and constitutes a second leakage route (42) in the direction of an annular groove (20) in such a way that the pressure compensation surface, which is otherwise always closed by the inner wall of the bore (5), produces a high-pressure fuel supply by way of the first leakage route (39) in the direction of the pressure compensation surface (36) and this pressure compensation surface (36) is in turn relieved by way of the second leakage route (42) in the direction of the annular groove (20). The disposition of the pressure compensation surface (36) diametrically opposite the distributor groove (12) results in a very favorable compensation of the forces acting on the distributor pump piston during the high-pressure delivery phase, wherein by way of the pressure supply by means of the leakage routes mentioned, these compensating forces can be brought into line with the respective pressure level and the loading of the distributor pump piston (FIG. 4).

27 Claims, 5 Drawing Sheets

FUEL INJECTION PUMP FOR AN INTERNAL COMBUSTION ENGINE

CROSS REFERENCE TO RELATED APPLICATIONS

This application is a 371 of PCT/DE98/00217 which was filed on Jan. 24, 1998.

PRIOR ART

The invention relates to a fuel injection pump for internal combustion engines. A fuel injection pump of this kind has been disclosed by DE-C-24 49 332, which has a pump piston that is driven to both reciprocate and also rotate in a housing bore. The outlet opening on the pump piston is used as a distributor opening, by way of which different pressure lines in succession can be supplied with high-pressure fuel. In this known fuel injection pump, approximately opposite from the distributor opening, a longitudinal groove is disposed in the jacket face of the pump piston, and this groove continuously communicates with the high-pressure fuel supplied to the distributor opening. With an embodiment of this kind, an application of pressure is produced between the pump piston and the housing bore, approximately diametrically opposite from the distributor opening, in such a way that the pump piston is uniformly loaded by compressive forces and the tendency of the piston to seize inside the housing bore is reduced. The additional groove regularly comes into communication with injection lines or with pressure lines not involved in the injection and in an intake phase of the pump piston, carries out a pressure compensation between these lines with an injection line that is simultaneously opened by the distributor opening.

This embodiment has the disadvantage that despite a force compensation that is achieved in the pump piston, an interruption of a lubricating oil film occurs due to the wide grooves in the jacket face of the moving part, which lubricating oil film is intended to carry the moving part, which is both the pump piston and the distributor, when it rotates in the housing bore.

ADVANTAGES OF THE INVENTION

The fuel injection pump according to the invention, has the advantage over the prior art that the pressure compensation surface according to the invention produces a compensation force that is independent of the rotational position of the moving part since the pressure compensation surface always remains intrinsically closed. The pressure that prevails in the region of the pressure compensation surface and is diverted by the output pressure of the high-pressure source to the adjoining outlet opening can be adjusted by dimensioning the first and second leakage routes in the desired fashion. This embodiment also has the advantage that with the high pressure that occurs in the region of the outlet opening as a result of the intermittently occurring high-pressure fuel injection, due to the deformation of the moving part on the one hand and of the housing bore on the other hand, the magnitude of the leakage routes, in particular their effective through flow cross section, is influenced so that an outflow cross section by way of the second leakage route is reduced and an inflow cross section by way of the first leakage route is increased. As a result, in the region of the pressure compensation surface, the pressure increases superproportionally with increasing high pressure. This pressure, which tends to increase more rapidly, produces a correspondingly higher compensation force counter to the force that is produced in the region of the outlet opening with the high-pressure increase. The lateral force resulting from the sum of the forces therefore only increases slowly as the pressure level of the high-pressure source rises. On the other hand, the compensation force decreases the deformation on the moving part and the housing bore containing it. In the moving part, these deformations are flattenings of the circular cross section in the direction of an elliptical cross section and in the housing bore, they are bore widenings, likewise with an elliptical cross section, wherein the main axes of the respective cross sections are disposed perpendicular to each other. With a reduction of this deformation, lesser lateral contractions or lateral widenings also occur lateral to the deformations being produced so that a smaller play between the moving part and the housing bore can be achieved in the fundamental dimensioning of these parts in relation to each other. With the reduction of this play, the quantity balance of the high-pressure injection improves by virtue of the fact that the leakage losses that arise by way of this play are reduced. This occurs with an even more reliable operation without the danger that by means of a play that is in turn too narrow, an excessive surface pressure occurs between the parts associated with each other, with the result of a seizing of the moving part in the housing bore.

In an advantageous embodiment, the second leakage route is essentially twice as long as the first leakage route, which produces a favorable quantity balance of high-pressure fuel flowing toward the pressure compensation surface and fuel flowing away again from this pressure compensation surface to a relief chamber. The pressure occurring in the region of the pressure compensation surface can be adjusted with the length of the leakage routes and the cross sections that occur.

In another advantageous embodiment, the object of the invention is attained with a distributor injection pump.

For the intentional positioning of the pressure compensation surface or for the accommodation of a number of pressure compensation surfaces in desired circumference regions of the moving part, the pressure compensation surfaces are advantageously embodied as a longitudinal groove or a flattening or ground surface that extends in a longitudinal direction in relation to the axis of the rotating, moving part. The pressure field in the region of the pressure compensation surface can advantageously be defined by means of the length of this longitudinal groove and a pressure compensation surface of this kind must be accommodated in a manner that facilitates the manufacture and implementation, between otherwise existing high pressure-carrying grooves or pressure relief grooves in the region of the jacket face of the moving part.

In an advantageous manner, a continuing groove is provided, which is chiefly used for adjusting the desired gap length in regions of the jacket face that are favorable for this adjustment. The pressure compensation surface can be disposed in a relatively isolated manner far from the high pressure-carrying outlet opening and can nevertheless reach a desired proximity to this outlet opening by way of the continuing groove or groove-like flattening in order to define the first leakage route there. Correspondingly, a leakage route length to a relief side can also be adjusted by way of this continuing groove.

According to the invention, the partial extension of the pressure compensation surface is carried out essentially parallel to a radial plane to the axis of the moving part, which permits the pressure compensation surface to be accommodated as much as possible in the circumference region of the jacket face in which the outlet opening is also provided, taking into consideration that during the reciprocating motion of the pump piston, the pressure compensation grooves do not extend into the region of relief openings that lead from the housing bore.

In a known manner, the distributor opening is embodied as a longitudinal groove, wherein, the continuing groove that leads from the pressure compensation surface is embodied as a partial annular groove, which ends in the axial direction above or below the distributor longitudinal groove and defines the first leakage route there. The second leakage route is formed by the pressure compensation surface and a conduit that likewise extends in the circumferential direction and is connected to a relief chamber of the fuel injection pump. According to the invention, a number of pressure compensation surfaces are advantageously provided, wherein, the surface area of the pressure compensation surface is advantageously greater than the surface area of the outlet opening that is directly acted on by the high pressure of the high-pressure fuel source.

BRIEF DESCRIPTION OF THE DRAWINGS

Four exemplary embodiments of the invention are represented in the drawings and will be explained in more detail in the description below.

DESCRIPTION OF THE EXEMPLARY EMBODIMENTS

Figure 1:
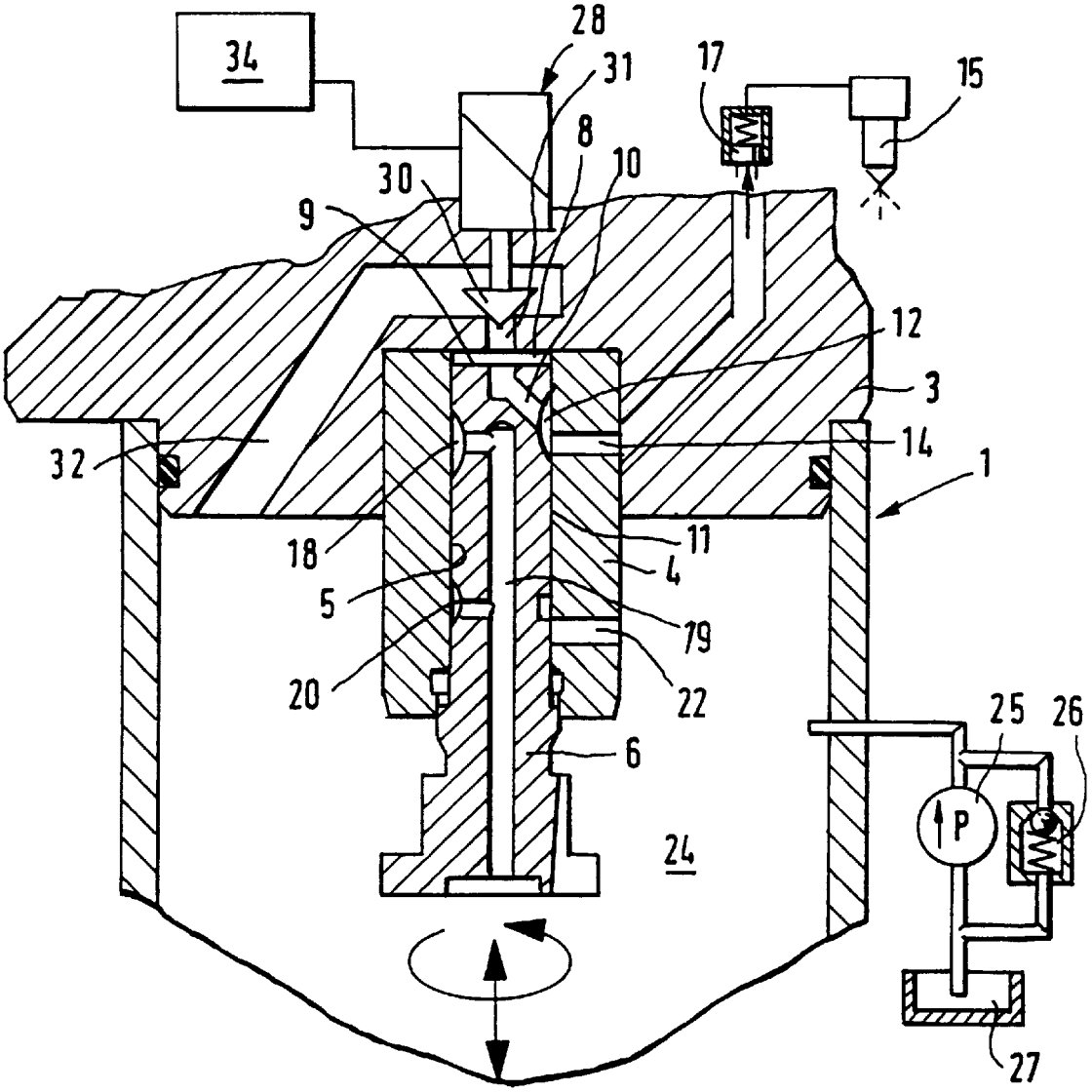
FIG. 1 PRIOR ART
FIG. 1 shows a fuel injection pump, which is represented in a simplified sectional view.

The invention will be explained below in conjunction with a fuel distributor injection pump of the reciprocating piston type. In a housing 1 of a distributor injection pump of this kind, a cylinder sleeve 4 is provided, which is press-fitted in a pump head 3, in whose axial bore 5 a distributor pump piston 6 is guided, which is set into a reciprocating motion as well as a rotating motion by a cam drive that is not shown in detail. In the course of its reciprocating motion, the distributor pump piston changes a pump work chamber 8, which it encloses on its end face in the cylinder sleeve 4, in such a way that with the downward stroke of the pump piston, which is simultaneously an intake stroke, this chamber gets larger and with the upward stroke of the pump piston corresponding to a feed stroke, it gets smaller while feeding fuel, which has been brought to high pressure, from this pump work chamber 8. To this end, the distributor pump piston has a supply conduit 10 that leads from its end face 9 and feeds in the jacket face 11 of the distributor pump piston into a distributor opening 12 as an outlet opening of the pump work chamber 8. This distributor opening is preferably embodied as a longitudinal groove. During its rotary motion with the respective feed stroke of the pump piston, the distributor opening comes into communication with one of several pressure lines 14, each of which leads as an injection line to a fuel injection valve 15 and which are disposed distributed on the circumference of the inner jacket face of the axial bore 5. A feed valve 17 is provided in each pressure line, e.g. as a constant pressure valve or as a valve with a valve member that has a continuously open throttle connection between the fuel injection valve and the fuel injection pump. In order to adjust a uniform output pressure in the pressure lines after pressure loading or injection has been achieved, a filling groove 18 in the jacket face 11 of the pump piston 6 is provided, which communicates by way of a longitudinal conduit 19 in the distributor pump piston 6 with an annular groove 20 in the jacket face of the distributor pump piston. This annular groove communicates with a relief bore 22 in the cylinder sleeve, which feeds in a pump suction chamber 24 of the fuel injection pump, which is supplied by means of a feed pump 25 aspirating from a fuel tank 27, if need be with the interposition of another pre-feed pump. The pressure in the pump intake chamber is adjusted with the aid of a pressure control valve 26, which is disposed parallel to the feed pump 25. This chamber is used as a low-pressure source (24) for fuel to fill the pump work chamber 8 during the intake stroke of the pump piston, to supply a pressure compensation, e.g. by way of the filling groove 18, and also to relieve and contain a part of the fuel that is displaced from the pump work chamber and does not undergo fuel injection. It is also possible to control an injection onset adjustment with this speed-dependent pressure.

The part of the fuel not participating in the fuel injection is controlled with the aid of a solenoid valve 29 whose valve member 30 produces a connecting bore 31 between the pump work chamber 8 and an intake conduit 32 leading to the pump intake chamber 24 when it lifts up from the valve seat of the solenoid valve. This connection is used on the one hand to fill the pump work chamber during the intake stroke of the pump piston and on the other hand, as mentioned above, to relieve the pump work chamber by way of a particular, definite stroke of the pump piston. This can occur before the actual pump piston stroke that is effective in feeding, in order to establish the onset of fuel injection and also after the injection of a desired fuel injection quantity, in order to establish the end of the high-pressure injection. The solenoid valve is electrically controlled by means of a control device 34.

Figure 2:
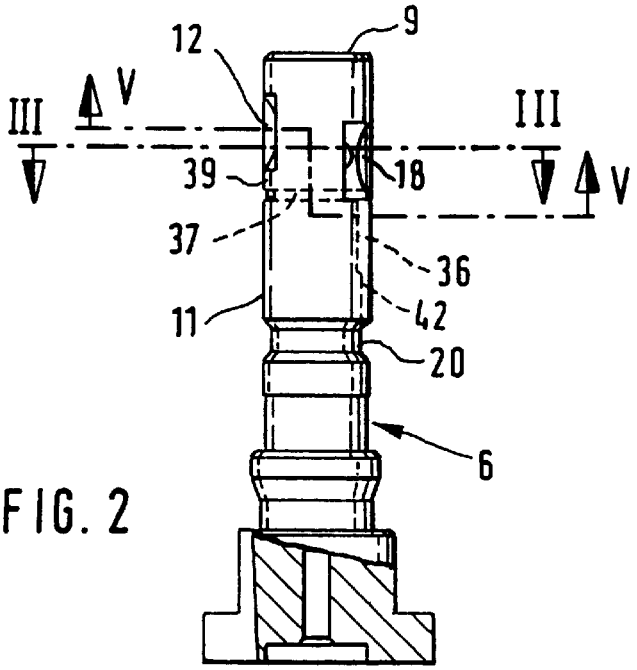
FIG. 2 shows a distributor piston in the view that is used with the pump according to FIG. 1.
Figure 3:
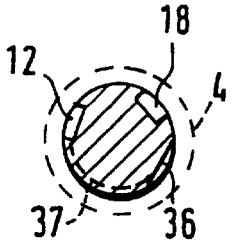
FIG. 3 shows a section along the line III—III through the distributor piston according to FIG. 2.

FIG. 1 shows the intrinsically known embodiment of the distributor injection pump, with a solenoid valve for controlling an injection quantity. An embodiment according to the invention, however, can first be seen in FIG. 2. The distributor groove 12, the filling groove 18, and a pressure compensation surface 36 can be seen in the pump piston represented there. The distributor opening 12 and the filling groove are embodied as longitudinal grooves. The pressure compensation surface 36 is likewise embodied like a longitudinal groove, e.g. in the form of a ground area. This pressure compensation surface, which is disposed approximately diametrically opposite the distributor groove 12, communicates with a partial annular groove 37, which extends to below the distributor groove 12. The associations of the pressure compensation surface 36, the distributor groove 12, and the filling groove 18 are clearly depicted in the sectional view in FIG. 3 and the partial annular groove 37 can also be seen depicted with dashed lines. In lieu of being embodied in the form of a ground area, the pressure compensation surface 36 can likewise also be embodied as a flattening produced in another manner. In the same manner, the partial annular groove can be embodied as a ground-in section. In its approach to the distributor opening 12, in the perpendicular distance to it, this groove defines a first leakage route 39. Likewise, the annular groove 20 can also be seen on the jacket face 11 of the distributor pump piston 6, which groove has already been represented in FIG. 1 and constitutes the lower limit of the sealing jacket face of the pump piston, which is defined on the other end by the partial annular groove 37.

Figure 4:
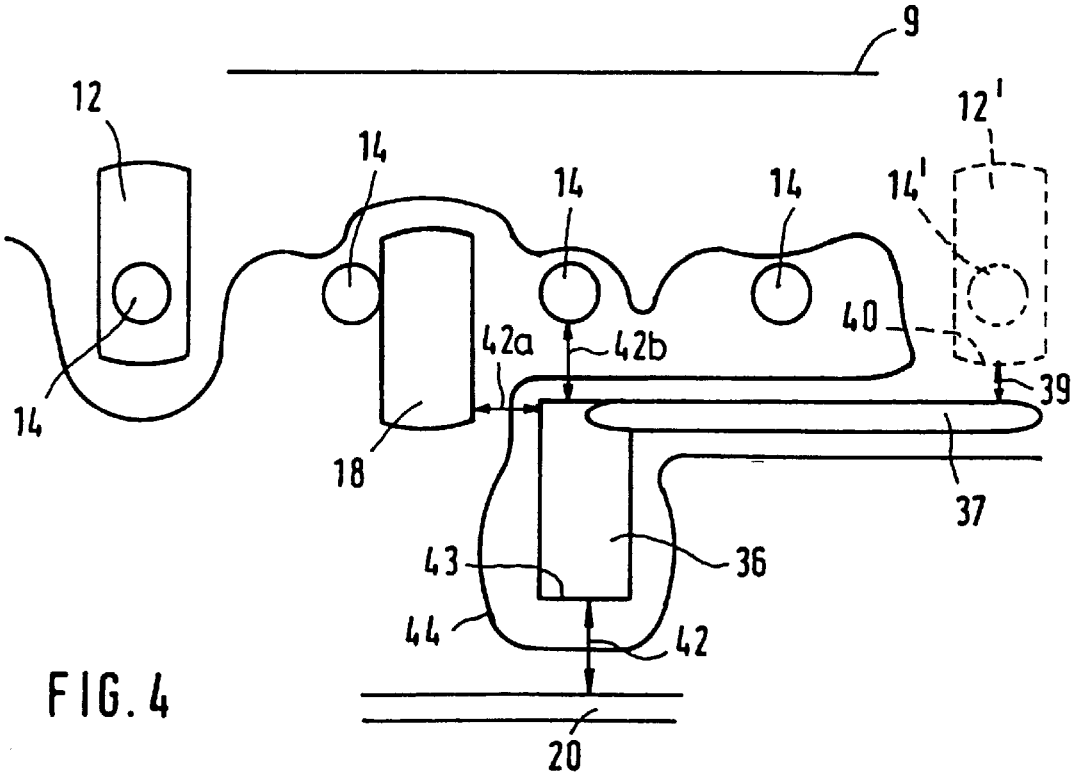
FIG. 4 shows a developed view of the distributor piston according to FIG. 2, together with the associated inner wall of the housing bore, with a depiction of the pressure lines leading away from this in a first embodiment.

These interrelationships are depicted even more clearly in FIG. 4 in the developed view of the pump piston jacket face, with the association of infeeds 14 of the pressure lines 14 into the axial bore 5. The line produced by the upper end face 9 is represented as the upper limit and the annular groove 20 is represented as the lower limit. The mouths of the pressure lines 14 are disposed between them in a common radial plane, with the same angular distance from one another. Furthermore, the distributor opening 12 is shown with dashed lines in its corresponding position 12' after a complete rotation. The pressure compensation surface 36 is disposed approximately in the center between these two positions and, with a certain spacing, which is greater than the length of the leakage route, is disposed beneath the radial plane defined by the bottom limit of the pressure line 14 remote from the pump work chamber. The partial annular groove 37 leads from this pressure compensation surface 36 that is embodied as a ground area or flattening, leading from its top limit oriented toward the pump work chamber, parallel to a radial plane of the distributor piston 6. As can be clearly seen here, the partial annular groove ends so that the partial annular groove and the distributor opening 12 overlap in the axial direction, wherein between the partial annular groove 37 and the bottom defining edge 40, the first leakage route 39 is formed by way of the gap present between the jacket face of the distributor pump piston and the jacket face of the axial bore 5. The second leakage route 42 is formed by means of the vertical distance between the annular groove 20 and the lower defining edge 43 remote from the pump work chamber 8. The filling groove 18, which is disposed in the intermediary region between the distributor opening 12 and the pressure compensation surface 36, is also shown in the developed view. This filling groove to a large extent overlaps the distributor opening 12 in the circumferential direction in such a way that upon rotation of the distributor pump piston 6, it can also come into connection with the individual mouths of the pressure lines 14. The line 44, which encloses the pressure compensation surface 36, indicates a line of a momentarily equal high pressure which prevails in the region between the jacket face of the distributor pump piston 6 and the housing bore during the feed stroke of the pump piston. It is clear that in the case of the high-pressure delivery, the vicinity of the distributor groove is acted on by high pressure, even into the gap between the jacket face 11 and the housing bore. On the other hand, this high pressure is decreased in the region of the filling groove 18 connected to the intake chamber 24 and also in the region of the mouths of the pressure lines 14 not involved in the high-pressure injection. In addition to the above-described leakage route 42, a leakage route can be embodied additionally or alternatively as a second leakage route 42 a or 42 b by way of the distance between the nearest defining edge of the pressure compensation surface 36 to the filling groove 18 or to one of the pressure lines 14 that have been pressure relieved in the meantime.

Figure 5:
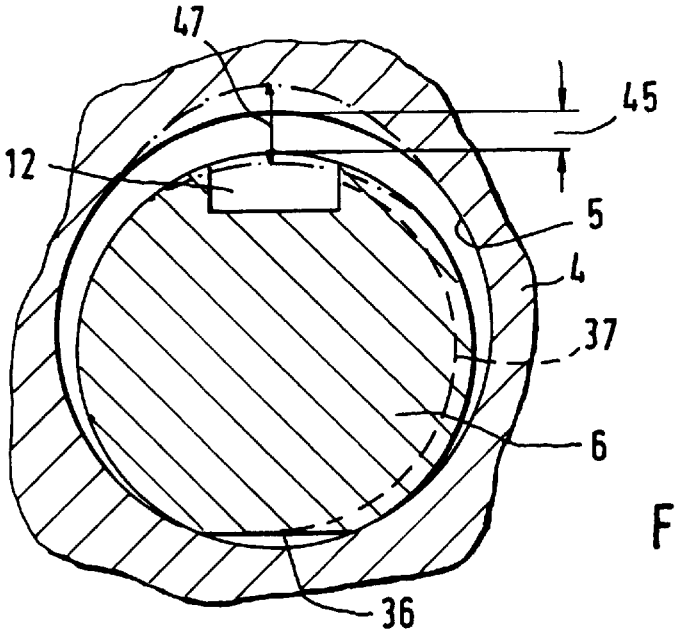
FIG. 5 shows a section through the pump piston along the line V—V of FIG. 2, and the housing part with the housing bore that contains it.

With a fuel injection pump embodied in this way, the distributor opening is intermittently acted on by high pressure from the pump work chamber. In the instance shown, the distributor opening is connected to one of the mouths 14 of the pressure lines in order to supply the fuel injection valve 15. The distributor pump piston 6 and the cylinder sleeve 4 are acted on intensely by the high pressure prevailing in the distributor groove 12. In the sectional view according to FIG. 5, this state is shown in an exaggerated fashion, wherein the section through the filling groove 18 has been omitted for the sake of a clear depiction. FIG. 5 shows the distributor groove 12 and the flattening of the pressure compensation surface 36, as well as the course of the partial annular groove 37, shown with dashed lines, which feeds into the pressure compensation surface 36 and begins below the distributor groove 12 but is not touched by it. When pressure is brought to bear, on the one hand, the high pressure produces a widening of the sleeve in the region of the distributor groove 12 and at the same time, produces a flattening of the distributor pump piston 6 in such a way that in contrast to the normal play 45 between the distributor pump piston and the bore of the cylinder sleeve 4, a significantly greater spacing 47 is now produced on this side, which facilitates the possible leakage flows. On the side diagonally opposite from the distributor groove 12, the normal play decreases considerably. In this region, the cross section of a possible leakage route, in this instance, particularly the cross section of the second leakage route 42, is also considerably reduced at the same time, which results in the fact that a relatively large amount of fuel at high pressure can be discharged into the partial annular groove 37 by way of the first leakage route in the region of the enlarged spacing 47 and reaches the pressure compensation surface 36. Due to the now lacking or reduced discharge by way of the second leakage route 42, a significant pressure increase occurs there, which is higher than would exist with a geometrical play that was equal all around and on the magnitude of the normal play. This pressure increase produces a high counterforce on the distributor pump piston, which counteracts the force resulting from the application of pressure in the region of the distributor opening 12. In this manner, the compensation forces, which are generated by the pressure compensation surface, are dynamically adapted to the respective pressure level. Thus, the normal play between the distributor pump piston and the axial bore 5 containing it can be kept lower than it can without the force compensation according to the invention. This produces a lower leakage loss during the entire operation of the distributor injection pump and therefore a higher efficiency of the pump and also results in the possibility of generating higher injection pressures. Furthermore, the force distribution assures that with this gap, which can be reduced in this manner, an excessively intense contact of the surfaces of the parts that move in relation to one another is nevertheless prevented and the danger of seizing is eliminated. As a result of the disposition of the pressure compensation surface according to the invention, with the first leakage route to the distributor groove 12 and the second leakage route 42 to the annular groove 20, a rather high surface area is available, which carries the distributor pump piston 6 inside the axial bore 5 and which additionally keeps the leakage losses in the direction of the low-pressure side small by way of this great length between the end face 9 and the annular groove 20. This and the dynamic pressure compensation, which adapts to the march of pressure in the pump work chamber, lead to a reliable construction with low leakage loss and a high degree of operational reliability.

Figure 6:
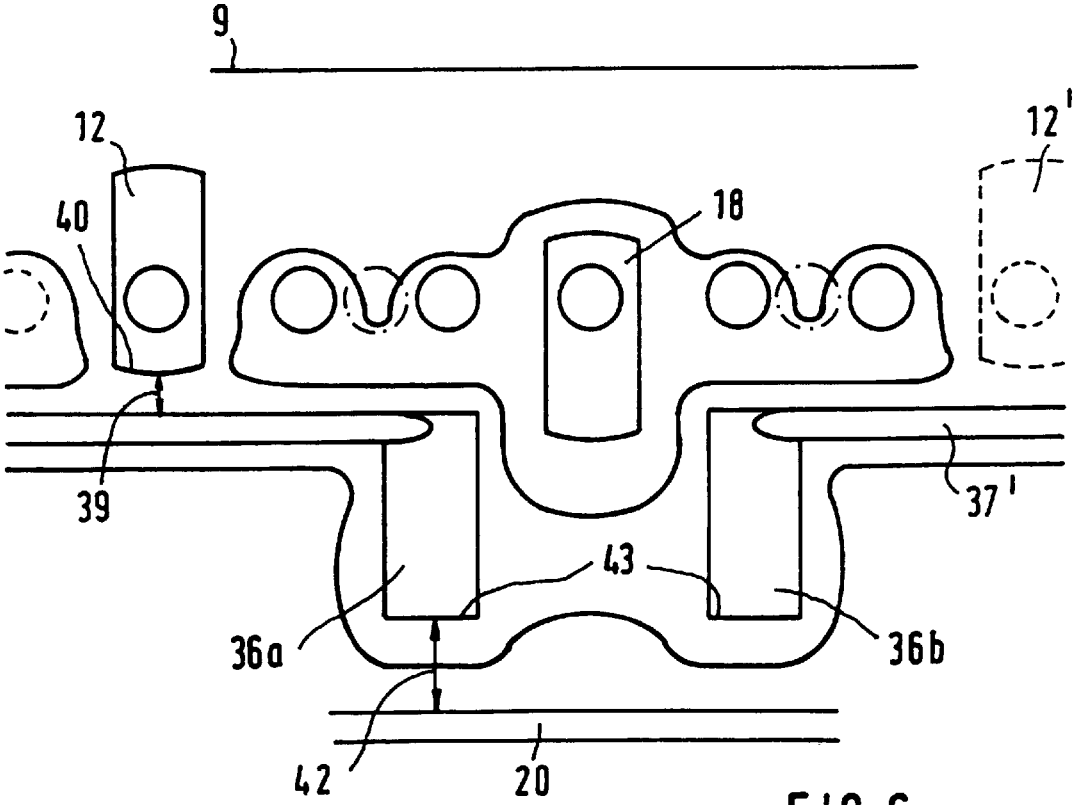
FIG. 6 shows a second exemplary embodiment of the invention in conjunction with a developed view of the pump piston.

An embodiment of the pump piston that is alternative to FIG. 4 is represented in FIG. 6, for its part, in the form of a developed view of the jacket face. In contrast to the exemplary embodiment according to FIG. 4, in this instance instead of one, two pressure compensation surfaces 36*a* and 36*b* are provided, which are now disposed symmetrical to the filling groove 18, which in turn is disposed diametrically opposite the distributor groove 12. These two pressure compensation surfaces 36*a* and 36*b* are in turn connected to each other by way of a partial annular groove 37' so that this partial annular groove describes nearly 360° with the exception of the region in which the filling groove 18 overlaps the pressure compensation surfaces 36*a* and 36*b* in the circumferential direction. The first leakage route 39, for its part, is formed by means of the vertical distance between the partial annular groove 37 and the lower edge 40 of the distributor groove 12, and the second leakage route is in turn formed between the annular groove 20 and the lower defining edge 43 of the pressure compensation surface 36*a* or 36*b*. The pressure compensation surfaces are preferably disposed each offset from the distributor groove 12 by 120°. In addition to this position of the second leakage route, the formation of a leakage route between the filling groove 18 and the pressure compensation surfaces 36*a* and 36*b*, respectively, would also be possible.

Figure 7:
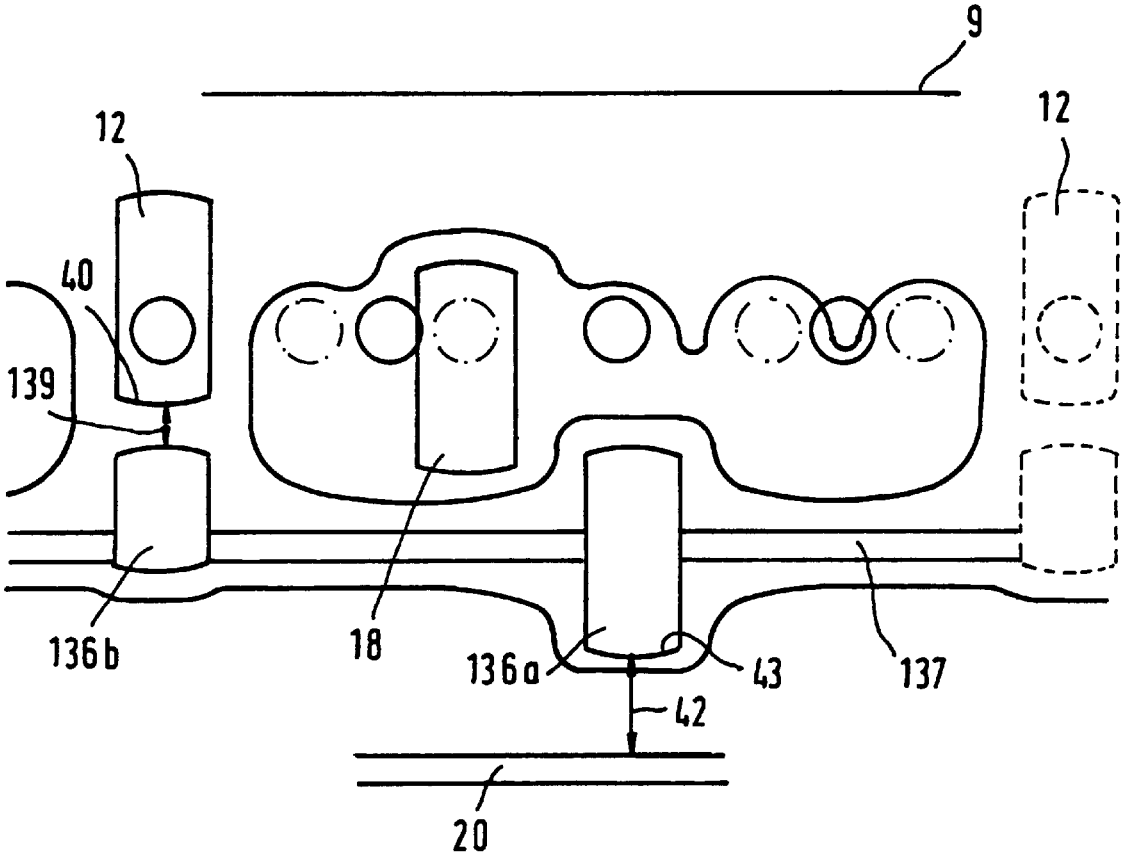
FIG. 7 shows a third exemplary embodiment of the invention, depicted in a developed view of the pump piston.

A third exemplary embodiment is represented in FIG. 7, which for its part follows from the exemplary embodiment according to FIG. 4. In this case, however, in addition to a pressure compensation surface 136*a*, a pressure field limiting surface 136*b* is provided, and these surfaces are now continuously connected to each other by means of an annular conduit 137. The second leakage route 42, for its part, is formed between the annular groove 20 and the lower limit 43 of the one pressure compensation surface 136*a*. In contrast, the first leakage route 139 is now disposed between the upper defining edge of the pressure field limiting surface 136*b* and the lower defining edge 40 of the distributor opening 12. The pressure field limiting surface 136*b* is also disposed flush to the distributor opening 12, i.e. the common center line constitutes a jacket line of the jacket face 11 of the distributor pump piston. In this embodiment, a compensation force is generated by means of the pressure compensation surface 136*a*, while the pressure field limiting surface 136*b* is chiefly used for producing compensation pressure, but is also used to limit the distributor groove pressure field and therefore the lateral force.

Figure 8:
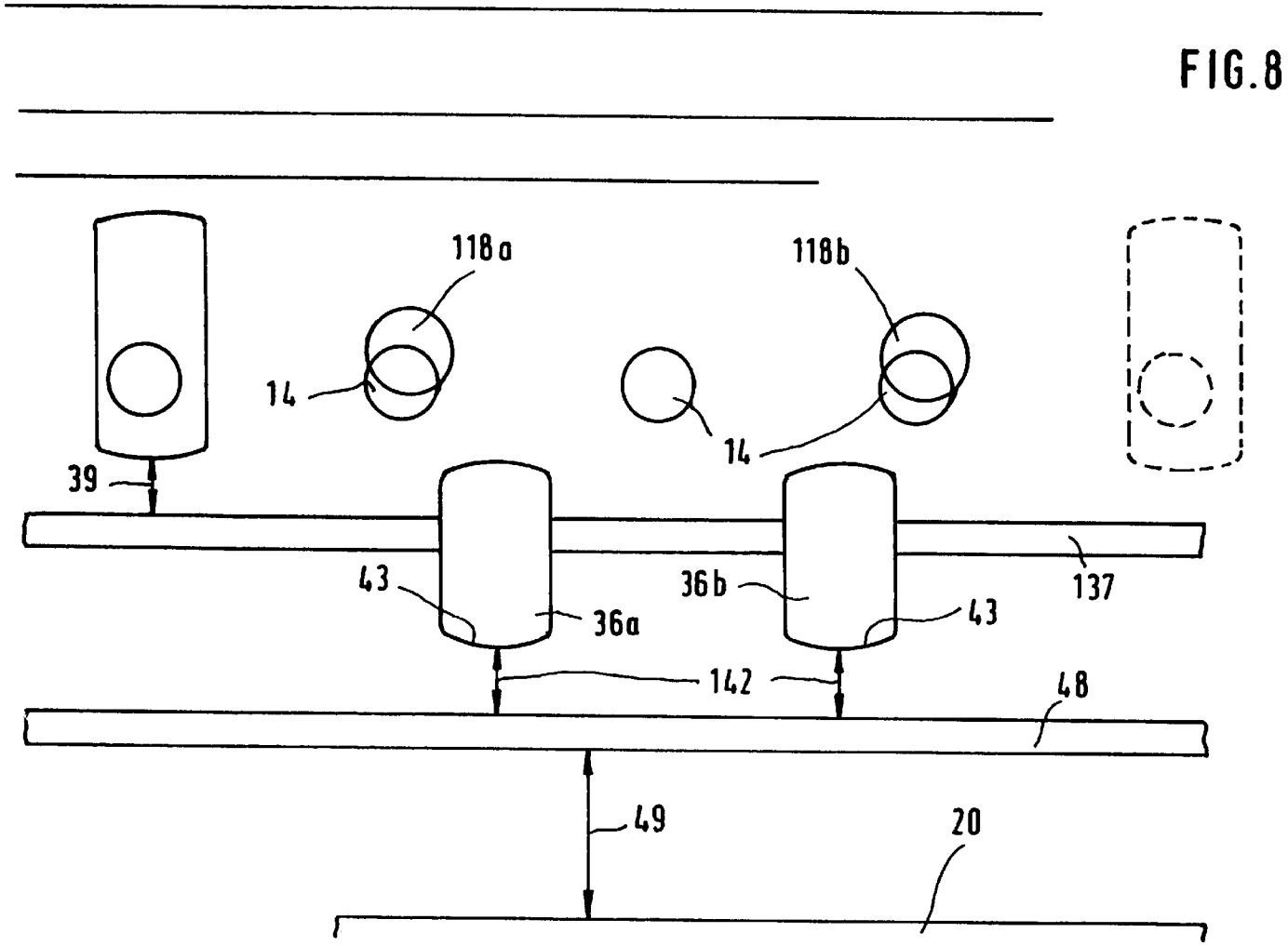
FIG. 8 shows a fourth exemplary embodiment of the invention with an additional annular groove.

A fourth exemplary embodiment is represented in FIG. 8, which for its part, follows from the exemplary embodiment according to FIG. 6. In this case, however, instead of the filling groove 18, two filling bores 118*a* and 118*b* are provided, which assume the filling function. The arrangement of the filling bores 118*a* and 118*b* are chosen so that during a complete work cycle (intake/feed), they respectively come to overlap with one of the injection lines 14. Preferably, the filling bores should be disposed 90° from the distributor groove. The second leakage gap 142 is formed between the lower defining edges 43 of the pressure compensation surfaces 36*a* and 36*b* and an additional annular groove 48 that runs around the jacket face of the distributor pump piston and is disposed above the annular groove 20. Another third leakage route 49 is formed between the additional annular groove 48 and the annular groove 20. The leakage volume that flows there from the additional annular groove 48 by way of the circumference to the annular groove 20 can vary in accordance with the course of the gap measure over the circumference of the distributor pump piston, by means of which different pressure conditions develop, which facilitate a force compensation. The third leakage route 49 is essentially 2.5 times the size of the second leakage route.

The foregoing relates to a preferred exemplary embodiment of the invention, it being understood that other variants and embodiments thereof are possible within the spirit and scope of the invention, the latter being defined by the appended claims.

What is claimed is:

1. A fuel injection pump for internal combustion engines, comprising a distribution pump piston (6), which is supported so that the distribution pump piston moves in a housing bore (5) and has a distributor outlet opening (12) on a jacket face (11) that is intermittently supplied with high-pressure fuel from a high-pressure pump work chamber (8) by way of a conduit (10) in the distribution pump piston, (6), and during a movement of the distribution pump piston, (6), the conduit (10) forms a connection with a pressure line (14) which leads from the housing bore (5) to transmit the fuel supplied from the high-pressure pump work chamber, at least one linear, flat pressure compensation surface (36; 36*a*, 36*b*; 136*a*, 136*b*) is provided on said distributor pump piston, said at least one pressure compensation surface is acted on by high pressure and is disposed on a side of the jacket face (11) opposite from the distributor outlet opening (12), during a stroke of the distribution pump piston (6), the at least one pressure compensation surface (36; 36*a*; 36*b*; 136*a*, 136*b*) is continuously covered by an inner wall of the housing bore (5) and remains closed and is connected by a first linear leakage passage (39) between the jacket face (11) of the distributor pump piston (6) and the inner wall of the housing bore (5) extends from the distributor outlet opening (12) of the fuel injection pump and is connected with a second leakage passage (42) to an annular groove (20) that is connected to a low-pressure intake chamber (24) and is disposed between the jacket face (11) of the distributor pump piston (6) and the housing bore (5).

2. The fuel injection pump according to claim 1, in that the second leakage passage (42) is essentially twice as long as the first linear leakage passage (39).

3. The fuel injection pump according to claim 2, in that the distribution pump piston is a rotary driven distributor (6), which includes the distributor outlet opening (12), said distributor outlet opening (12) is periodically supplied with high-pressure fuel and in a course of a rotation of the distributor (6) the distributor outlet opening (12) is connected successively with different outlet pressure lines (14) that lead from the housing bore (5) on the circumference of the distributor (6) in order to transmit the fuel fed to the distributor opening (12) respectively to injection valves at high pressure.

4. The fuel injection pump according to claim 3, in that the at least one pressure compensation surface (36; 36*a*, 36*b*; 136*a*, 136*b*) is a longitudinal groove or a flattening or ground surface that extends in a longitudinal direction parallel to an axis of the rotating moving part.

5. The fuel injection pump according to claim 2, in that the at least one pressure compensation surface (36; 36*a*, 36*b*; 136*a*, 136*b*) is a longitudinal groove or a flattening or ground surface that extends in a longitudinal direction parallel to an axis of the rotating moving part.

6. The fuel injection pump according to claim 2, in that the at least one pressure compensation surface (36; 36*a*, 36*b*; 136*a*, 136*b*) of the moving part (6) has at least a partial extension that is in a form of a continuing groove or groove-like flattening (37, 37', 137), which is let into the jacket face and extends into a region of the jacket face (11) in which, between the moving part (6) and the housing bore (5), there is a small spacing from the high pressure-carrying parts, which is defined as a first leakage route (39).

7. The fuel injection pump according to claim 2, in that the second leakage passage (42) is formed between the pressure compensation surface (36; 36*a*, 36*b*; 136*a*) and a filling groove (18) that is disposed adjacent there to in the circumference direction of the distributor pump piston and is connected to the low-pressure source (24).

8. The fuel injection pump according to claim 1, in that the distribution pump piston is a rotary driven distributor (6), which includes the distributor outlet opening (12), said distributor opening (12) is periodically supplied with high-pressure fuel and in a course of a rotation of the distributor (6) the distributor outlet opening (12) is connected successively with different outlet pressure lines (14) that lead from the housing bore (5) on the circumference of the distributor (6) to transmit the fuel fed to the distributor opening (12) respectively to injection valves at high pressure.

9. The fuel injection pump according to claim 8, in that the at least one pressure compensation surface (36; 36*a*, 36*b*; 136*a*, 136*b*) is a longitudinal groove or a flattening or ground surface that extends in a longitudinal direction parallel to an axis of the rotating moving part.

10. The fuel injection pump according to claim 8, in that the at least one pressure compensation surface (36; 36*a*, 36*b*; 136*a*, 136*b*) of the moving part (6) has at least a partial extension that is in a form of a continuing groove or groove-like flattening (37, 37', 137), which is let into the jacket face and extends into a region of the jacket face (11) in which, between the moving part (6) and the housing bore (5), there is a small spacing from the high pressure-carrying parts, which is defined as a first leakage route (39).

11. The fuel injection pump according to claim 1, in that the at least one linear flat pressure compensation surface (36; 36*a*, 36*b*; 136*a*, 136*b*) is a longitudinal groove or a flattening or ground surface that extends in a longitudinal direction parallel to an axis of the rotating moving part.

12. The fuel injection pump according to claim 11, in that the at least one pressure compensation surface (36; 36*a*, 36*b*; 136*a*, 136*b*) of the moving part (6) has at least a partial extension that is in a form of a continuing groove or groove-like flattening (37, 37', 137), which is let into the jacket face and extends into a region of the jacket face (11) in which between the distributor pump piston (6) and the housing bore (5), there is an extremely small spacing from the high pressure-carrying parts, which is designed as a first leakage route (39).

13. The fuel injection pump according to claim 11, in that a number of pressure compensation surfaces are provided, which are connected to one another by means of a continuous groove (137) that is let formed in the jacket face and extends parallel to a radial plane to the axis of the distributor pump piston (6).

14. The fuel injection pump according to claim 13, in that the jacket face (11) of the distributor pump piston (6), two pressure compensation surfaces (36*a*, 36*b*) are provided that are disposed at essentially equal angular intervals from each other and from the distributor outlet groove (12) and furthermore, two filling bores (118*a*, 118*b*) are provided, which in the rotation of distribution pump piston (6), connect the pressure lines (14), which are not acted on by injection pressure, and connect the pressure lines (14) as the region, which is connected to the low-pressure source, to a discharge chamber, and angular spacings of these filling bores from one another and from the distributor outlet groove (12) are determined by an infeed of the pressure lines (14) and these filling bores are disposed essentially opposite the two pressure compensation surfaces.

15. The fuel injection pump according to claim 14, in that an additional annular groove (48) is provided between the compensation surfaces (36*a*, 36*b*) and the annular groove (20) connected to the low-pressure source (24) and a third leakage passage (49) is formed between the additional annular groove (48) and the annular groove (20).

16. The fuel injection pump according to claim 15, in that a length of the third leakage passage (49) is essentially 2.5 times a length of the second leakage passage (142).

17. The fuel injection pump according to claim 1, in that the at least one pressure compensation surface (36; 36*a*, 36*b*; 136*a*, 136*b*) of the distribution pump piston (6) has at least a partial extension that is in a form of a continuing groove or groove-like flattening (37, 37', 137), which is formed in the jacket face and extends into a region of the jacket face (11) in which, between the distribution pump piston (6) and the housing bore (5), there is a small spacing between the distributor pump piston and the housing bore which is defined as a first leakage spacing (39).

18. The fuel injection pump according to claim 17, in that the partial extension (37, 37', 137) of the pressure compensation surface extends essentially parallel to a radial plane to the axis of the distributor pump piston (6).

19. The fuel pump according to claim 18, in that the distributor outlet opening (12) is formed in the jacket face of the distribution pump piston.

20. The fuel injection pump according to claim 18, in that the groove or the groove-like flattening (36; 36*a*, 36*b*; 136*a*, 136*b*) and a second groove or groove-like flattening are embodied in the form of a partial annular groove (37, 37') that is disposed parallel to a radial plane of the distributor pump piston, whose end is disposed axially overlapping the high pressure distributor outlet opening (12).

21. The fuel injection pump according to claim 17, in that the distributor outlet opening (12) is formed in the jacket face of the distributor pump piston.

22. The fuel injection pump according to claim 21, in that the groove or the groove-like flattening (36; 36*a*, 36*b*; 136*a*, 136*b*) and a second groove or groove-like flattening are embodied in the form of a partial annular groove (37, 37') that is disposed parallel to a radial plane of the distributor pump piston, whose end is disposed axially overlapping the high pressure distributor outlet opening (12).

23. The fuel injection pump according to claim 17, in that the first groove or the groove-like flattening (36; 36*a*, 36; 136*a*, 136*b*) and a second groove or groove-like flattening are embodied in the form of a partial annular groove (37, 37') that is disposed parallel to a radial plane of the distribution pump piston, whose end is disposed axially overlapping the high pressure distribution outlet opening (12).

24. The fuel injection pump according to claim 1, in that the second leakage passage (42) is formed between the pressure compensation surface (36; 36*a*, 36*b*; 136*a*) and a filling groove (18) that is disposed adjacent there to in the circumference direction of the distributor pump piston and is connected to the low-pressure source (24).

25. The fuel injection pump according to claim 24, in that the filling groove connected to the low-pressure source extends into an annular groove (20) in the jacket face (11) of the distribution pump piston (6).

26. The fuel injection pump according to claim 24, in that in the jacket face (11) of the distributor pump piston (6), two pressure compensation surfaces (36*a*, 36*b*) are provided that are symmetrical to the filling groove (18) and disposed essentially opposite the distributor groove, said filling groove (18), and the pressure lines (14) are connected to a discharge chamber during the rotation of the distributor pump piston (6).

27. The fuel injection pump according to claim 1, in that the size of the at least one compensation surface (36) corresponds to an area of the distributor outlet opening (12).

* * * * *

UNITED STATES PATENT AND TRADEMARK OFFICE

CERTIFICATE OF CORRECTION

PATENT NO. : 6,152,708

DATED : November 28, 2000

INVENTOR(S) : Karl-Friedrich Ruessler et al

It is certified that error appears in the above-identified patent and that said Letters Patent are hereby corrected as shown below:

The name of the second applicant is incorrect. Please correct to read as follows:

– BERNHARD BONSE–

Signed and Sealed this

First Day of May, 2001

*Attest:*

Nicholas P. Godici

NICHOLAS P. GODICI

*Attesting Officer*

*Acting Director of the United States Patent and Trademark Office*